US006840785B2

(12) United States Patent
Drane

(10) Patent No.: US 6,840,785 B2
(45) Date of Patent: Jan. 11, 2005

(54) COVER ASSEMBLY FOR AN ELECTRICAL BOX

(75) Inventor: Mark R. Drane, Germantown, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 10/384,190

(22) Filed: Mar. 7, 2003

(65) Prior Publication Data

US 2004/0175975 A1 Sep. 9, 2004

(51) Int. Cl.[7] ..... H01R 13/44
(52) U.S. Cl. ..... 439/138; 439/142; 439/536; 16/382
(58) Field of Search ..... 439/142, 136, 439/535, 536, 538, 548, 952, 138, 135, 372, 13; 16/261–263, 382

(56) References Cited

U.S. PATENT DOCUMENTS

| | | | | |
|---|---|---|---|---|
| 2,271,630 A | | 2/1942 | Dahlgren | |
| 2,960,254 A | | 11/1960 | Kiba | |
| 3,894,654 A | | 7/1975 | Frankenberg | |
| 4,381,063 A | | 4/1983 | Leong | |
| 4,443,654 A | | 4/1984 | Flachbarth et al. | |
| 4,883,924 A | | 11/1989 | Hadfield | |
| 5,010,211 A | | 4/1991 | Bartee | |
| 5,032,690 A | | 7/1991 | Bloom | |
| 5,160,808 A | | 11/1992 | Hadfield | |
| 5,195,288 A | | 3/1993 | Penczak | |
| 5,210,906 A | * | 5/1993 | Aihara et al. | 16/232 |
| 5,272,278 A | | 12/1993 | Wuertz | |
| 5,342,993 A | | 8/1994 | Siems | |
| 5,382,171 A | | 1/1995 | Hofmann et al. | |
| 5,393,930 A | | 2/1995 | Wuertz | |
| 5,410,103 A | | 4/1995 | Wuertz | |
| 5,422,434 A | | 6/1995 | Wuertz et al. | |
| 5,466,886 A | | 11/1995 | Lengyel et al. | |
| 5,575,668 A | | 11/1996 | Timmerman | |
| 5,696,349 A | | 12/1997 | Bera | |
| 5,724,704 A | * | 3/1998 | Seo | 16/254 |
| 5,747,732 A | | 5/1998 | Bera et al. | |
| 5,751,544 A | * | 5/1998 | Song | 361/681 |
| 5,763,826 A | | 6/1998 | Castellani et al. | |

(List continued on next page.)

OTHER PUBLICATIONS

U.S. patent application Ser. No. 10/307,889, Drane, filed Dec. 2, 2002.

U.S. patent application Ser. No. 10/335,230, Drane, filed Dec. 31, 2002.

TradeMaster® Floor Box and Covers, *Pass & Seymour legrand®*, catalog description of Floor Box Covers (1999).

Thomas & Betts Electrical Components, Products and Systems *Technical/Specification Catalog* Electrical Components Division, catalog pp. J/830–J/867; J/897–J/900; M/990–M/996 (1994).

*Primary Examiner*—Gary Paumen
*Assistant Examiner*—Edwin A. Leon
(74) *Attorney, Agent, or Firm*—Hoffmann & Baron, LLP

(57) ABSTRACT

A cover assembly for an electrical box including a frame having an opening positionable over the electrical box and a cover selectively positionable over the opening and rotatable between a closed position and an open position. A hinge rotatably secures the cover to the frame and permits rotational and translational movement of the cover relative to the frame. The hinge includes a biasing device for urging the cover toward a first translational direction. A latch including a locking element is disposed between the cover and the frame for retaining the cover in the closed position. The biasing device deflects upon movement of the cover into the closed position and urges the locking element into a retaining position such that the locking element restricts movement of the cover to the open position.

33 Claims, 10 Drawing Sheets

U.S. PATENT DOCUMENTS 5,783,774 A 7/1998 Bowman et al.
6,000,550 A * 12/1999 Simpson et al. ..... 206/711
6,018,126 A 1/2000 Castellani et al.
6,041,478 A 3/2000 Martin
6,046,405 A 4/2000 Obermann
6,114,623 A 9/2000 Bonilla et al.
6,175,078 B1 1/2001 Bambardekar et al.
6,179,634 B1 1/2001 Hull et al.
6,265,662 B1 7/2001 Riedy et al.
6,307,152 B1 10/2001 Bonilla et al.
6,395,978 B1 5/2002 Whitehead et al.
6,507,485 B2 * 1/2003 Zadesky ..... 439/536 X
6,779,434 B2 * 8/2004 Hsu ..... 99/288

* cited by examiner

COVER ASSEMBLY FOR AN ELECTRICAL BOX

FIELD OF INVENTION

The present invention relates to a cover assembly for an electrical box and more specifically to a cover assembly for an electrical floor box having a cover which is easily and securely held in the closed position.

BACKGROUND OF THE INVENTION

In office space and other commercial environments it is often desirable to have access to electrical outlets or other electrical connections at locations located a distance from standard wall outlets. In order to safely accommodate such situations, floor boxes are typically used. These electrical boxes may be located in the floor near or at the location, such as under a work cubicle or near a piece of machinery, where the connection is needed. The electrical connections may be electrical outlets, telephone jacks or data connections used for networking computers.

Floor boxes may include a flange which sits on top of the floor surface and includes an opening to permit access to the electrical connections. A cover is typically removably positionable over the opening and moveable between an open and closed position. The cover prevents inadvertent contact with the connectors and to restricts debris, including fluids, from contaminating the connectors. One such covered floor box is shown in U.S. Pat. No. 6,179,634. Once in the closed position, the covers are typically secured such that they are not inadvertently opened.

Floor box covers are often formed of a metallic material such as brass or aluminum in order to withstand the wear and tear which floor mounted fixtures endure. Covers for metal floor boxes are typically secured in the closed position by screwing them onto the flange. One such floor box which is commercially available is the Thomas & Betts 762 Series Floor Box. Other known floor boxes employ a turn screw fastener which requires the rotation of a screw to latch and unlatch the cover. This type of cover may be moved into the closed position but not secured, making it difficult to determine for visual inspection if the cover is latched. Both the screw on cover and screw fastener covers require time to secure the cover and also require the use of a tool. Other covers are kept in the closed position by a resilient clasp located at the front of the cover opposite the hinge. Such a clasp may be located on the cover or the flange. Such clasps are often separate elements which must be secured to the cover, thereby requiring additional parts and assembly time thereby complicating manufacturing.

Accordingly, it would be desirable to provide an electrical floor box cover which may be securely retained in the closed position and is easy to use and manufacture.

SUMMARY OF THE INVENTION

It is an advantage of the present invention to provide a cover assembly for an electrical box It is another advantage of the present invention to provide a cover assembly for an electrical floor box.

It is a further advantage of the present invention to provide a cover assembly for an electrical floor box having a cover that is easily secured in the closed position and cost efficient to manufacture.

It is still a further advantage of the present invention to provide an electrical floor box having a cover pivotally connected to a frame by a hinge. The hinge permits both rotational and translational movement of the cover relative to the frame. The hinge includes a biasing means for urging the cover into a latched position when the cover is in a closed position.

It is yet a further advantage of the present invention to provide a hinge for an electrical box cover including a cover and frame having a resilient elongate pin supported at each end thereof on either the cover or the frame. A pin retainer is positionable over the pin and the retainer is attachable to either the cover or the frame. The retainer includes a first section for preventing deflection of the pin and a second section configured to permit deflection of the pin. The hinge permits rotation and translation of the cover relative to the frame.

It is a further advantage of the present invention to provide a cover assembly for an electrical box including a frame having an opening positionable over the box and a cover selectively positionable over the opening and rotatable between a closed position and an open position. A hinge rotatably secures the cover to the frame and permits rotational and translational movement of the cover relative to the frame. The hinge includes a biasing device for urging the cover toward a first translational direction. A latch including a locking element is disposed between the cover and the frame for retaining the cover in the closed position. The biasing device deflects upon movement of the cover into the closed position and urges the locking element into a retaining position such that the locking element restricts movement of the cover to the open position.

In the efficient attainment of these and other advantages the present invention provides a cover assembly for an electrical box including a frame having an opening positionable over the box. A cover is selectively positionable over the opening and rotatable between a closed position and an open position. A hinge rotatably secures the cover to the frame. The hinge permits rotational and translational movement of the cover relative to the frame. The hinge includes a biasing device for urging the cover toward a first translational direction. A locking element is disposed between the cover and the frame for retaining the cover in the closed position.

In the preferred embodiment, the cover is movable in a second translational direction opposed to the first translational direction and against the biasing device such that the locking element is moved into an unretained position permitting the cover to be rotated to the open position. The hinge includes an elongate member joining the cover and the frame which forms the biasing device. A portion of the elongate member that is located between the ends of the elongate member is restricted from deflecting upon translational movement of the cover.

The hinge may further include a retainer disposable adjacent the elongate member. The elongate member being a pin. The retainer includes a first section for restricting deflection of a pin central portion and a second section permitting deflection of peripheral portions of the pin. The retainer further includes a groove forming the first and second sections for receiving the pin, the first section being narrower than the second section.

A preferred form of the electrical box cover assembly, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
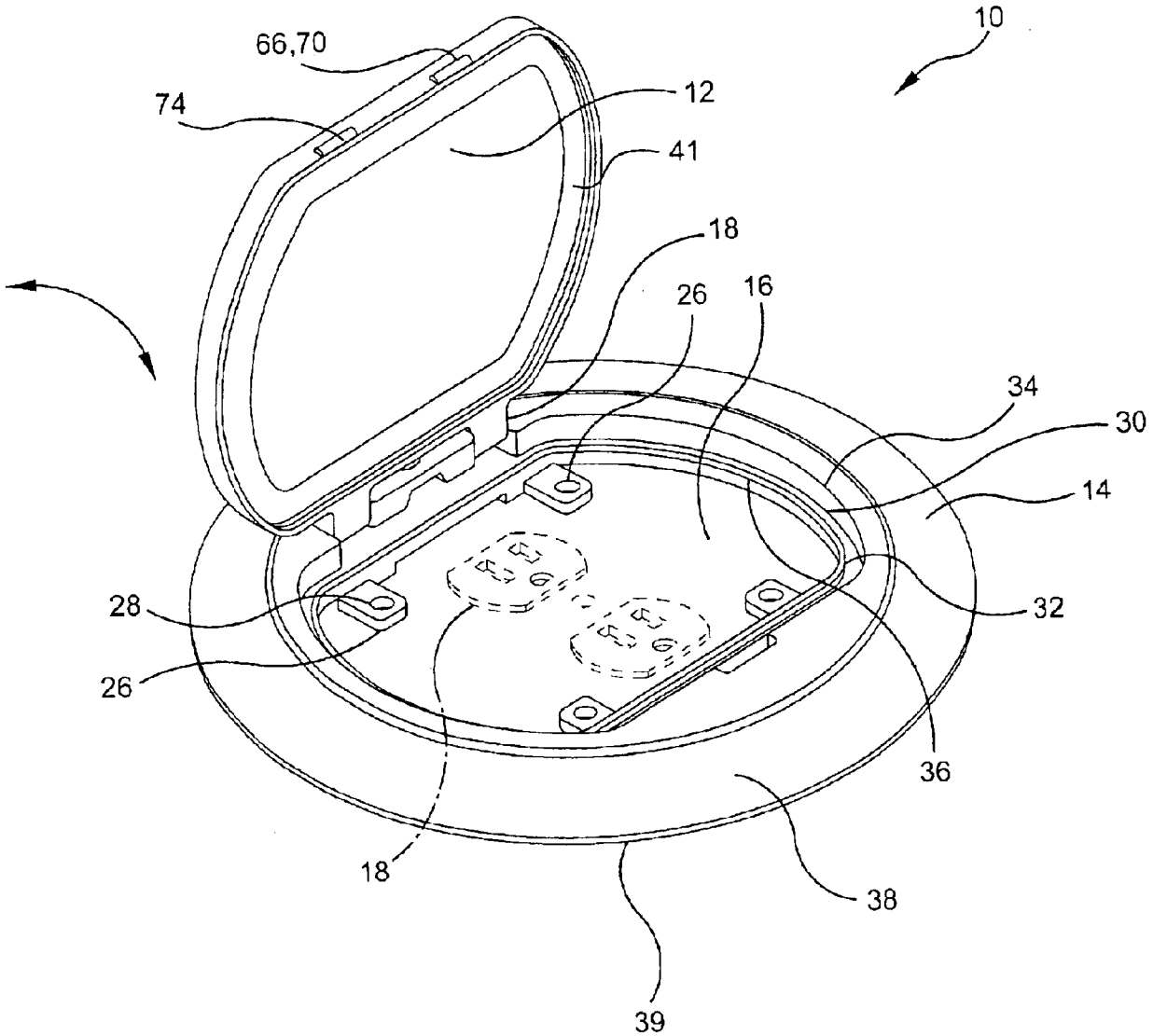
FIG. 1 is a top perspective view of the electrical box cover assembly of the present invention showing the cover in an open position.

The present invention provides an electrical box cover assembly which is positionable on top of an electrical box. The cover assembly is particularly suited for use with an electrical box disposed in a floor. The electrical box may include connections for power or voice/data devices as is well known in the art. The electrical box cover assembly includes a cover which is easily securable in the closed position and securely held therein. While electrical box cover assembly is described herein on a floor box application, it is within the contemplation of the present invention that cover assembly 10 may be used on a wide variety of electrical boxes and other applications where a cover that can be selectively opened is desired.

With reference to FIGS. 1, and 2–4, electrical box cover assembly 10 includes a cover 12 which is securable to frame 14. Frame 14 has an opening 16 that is selectively positionable over an electrical box 20. Cover 12 is movable between an open and closed position to selectively cover and uncover opening 16 to provide access to electrical connectors 18 held within electrical box 20. Cover 12 may be releasably secured in the closed position by a latch 22 disposed between cover 12 and frame 14 for retaining cover 12 in the closed position. In the preferred embodiment, cover 12 is pivotally attached to frame 14 by a hinge 24. Frame 14 is preferably a generally annular flange-like member having a central opening 16 through which access to the electrical connectors 18 is obtained. It is within the contemplation of the invention that frame 14 could be of any one of a variety of shapes, e.g., round, square, rectangular, etc., to conform to the shape of the box disposed below. Frame 14 may include tabs 26 having apertures 28 to permit fasteners (not shown) to pass through and into corresponding apertures in the electrical box 20 and secure electrical box 20 to frame 14. Frame 14 provides a transition from the surrounding floor to the electrical box and may be placed over a variety of floor surfaces including carpet, wood or tile. Cover and frame are preferably formed of a rigid metallic material such as brass or aluminum. However, it is within the contemplation of the present invention that cover 12 and frame 14 could be formed out of a variety of materials including plastics.

Figure 3:
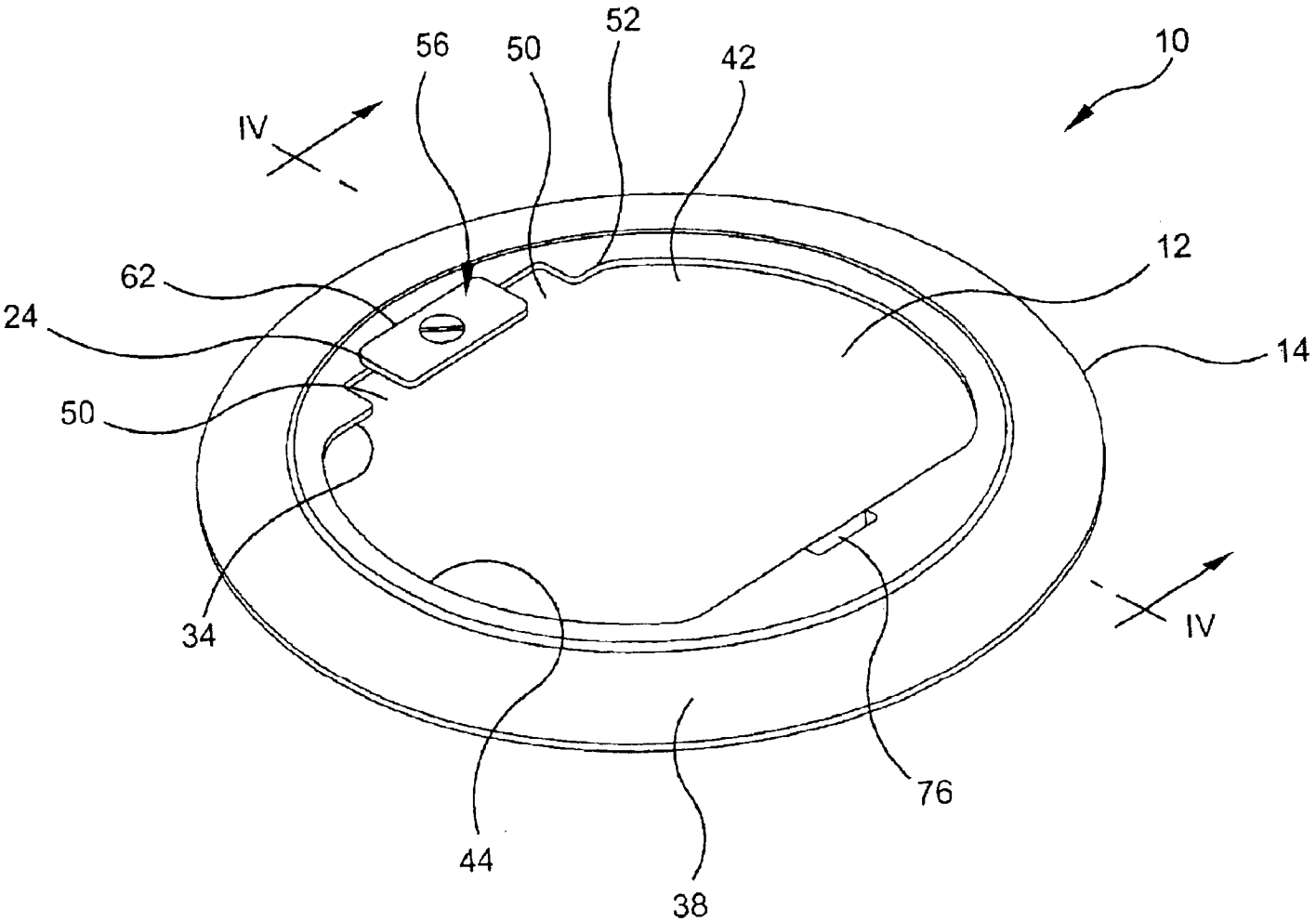
FIG. 3 is a top perspective view of the electrical box cover of FIG. 1 showing the cover in the closed position.

Frame 14 further includes an annular channel 30 extending about opening 16. Channel 30 has a bottom 32 peripherally bounded by an upstanding outer wall 34 and an upstanding inner wall 36. When cover 12 is closed, the top surface of cover 12 is substantially at the same level as the top of outer wall 34 as shown in FIG. 3. Extending radially beyond outer wall 34 is an annular beveled surface 38 which ends at the peripheral edge 39 of the frame 14. When electrical box 20 is installed, cover frame 14 and cover 12 are slightly raised above the surface of the floor. Beveled surface 38 provides a smooth tapered transition from the floor to prevent tripping. When cover 12 is in the closed position, a narrow gap 42 exists between the outer periphery 44 of cover 12 and outer wall 34. A gasket 41 may be positioned between cover 12 and frame 14 to prevent a fluid such as cleaning water from entering opening 16 and contaminating electrical box 20. Gasket 41 may be disposed on the bottom surface of cover 12 and seal on the top of inner wall 36 when cover 12 is in the closed position. Alternatively, gasket 41 may be positioned in channel 30 and seal against cover 12 when in the closed position. Gasket may be formed of any of a number of resilient materials, e.g., rubber, polyurethane, etc., which are well known in the art. Accordingly, any fluid which may enter gap 42 is prevented from entering through opening 16.

Figure 1A:
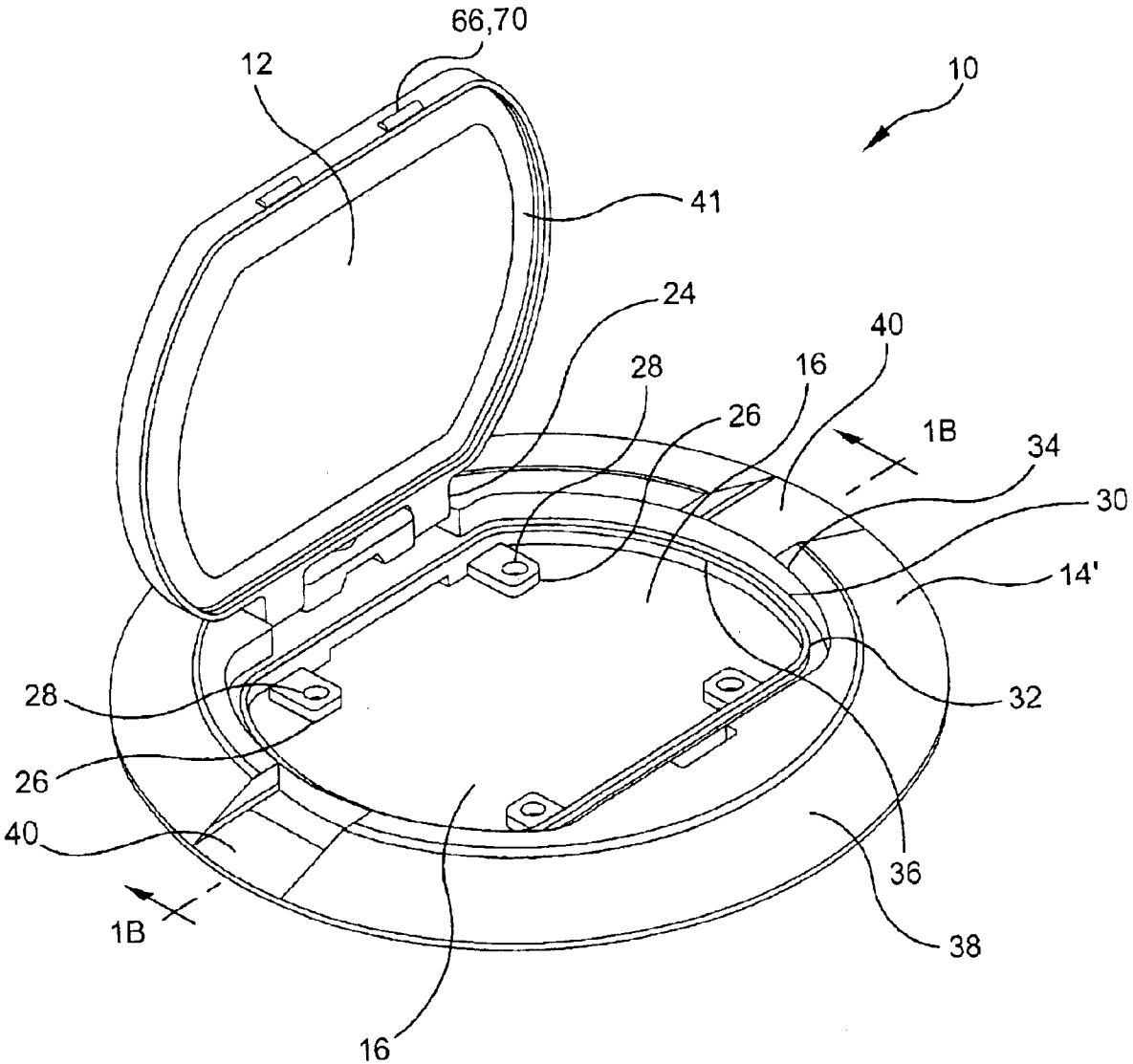
FIG. 1A is a top perspective view of an alternative embodiment of the electrical box cover assembly of the present invention showing the cover in an open position.
Figure 1B:
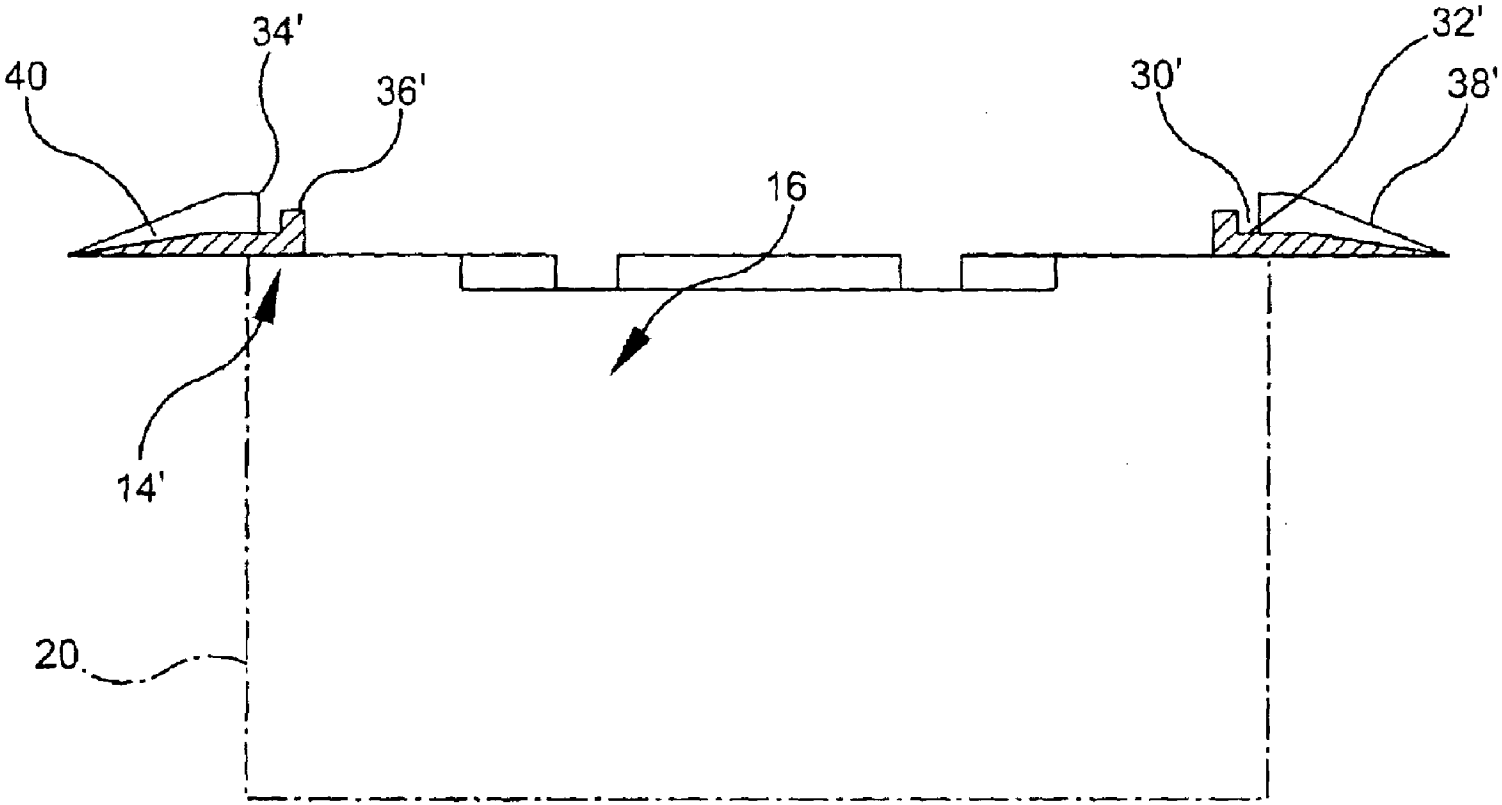
FIG. 1B is a cross-sectional view of the electrical box cover assembly taken along line IB—IB of FIG. 1A.

In an alternative embodiment is shown in FIGS. 1A and 1B. This alternative embodiment is similar to that shown in FIGS. 1 and 2–6, however, frame 14' may further include a plurality of slots 40 formed in the outer wall 34' and beveled surface 38'. Slots 40 creates interruptions in outer wall 34'. In the previously described embodiment shown in FIGS. 1, 2–6, when cover 12 is in the closed position, a narrow gap 42 exists between the outer periphery 44 of cover 12 and outer wall 34. Fluid falling on cover 12 may enter gap 42 and collect in channel 30. In this alternative embodiment, However, before the fluid can rise above inner wall 36', the fluid will flow out through slots 40 and drain away from frame 14'. Accordingly, channel 30' and slots 40 provide a water resistance feature to the present invention which is described in commonly assigned copending U.S. application Ser. No. 10/335,230, filed Dec. 31, 2002, which is incorporated by reference herein in its entirety. By using slots 40 a certain degree of resistance to fluid is achievable even without the use of a gasket. If additional fluid resistance is desirable, then a gasket such as that shown in FIG. 1 may be used in this embodiment.

Figure 2:
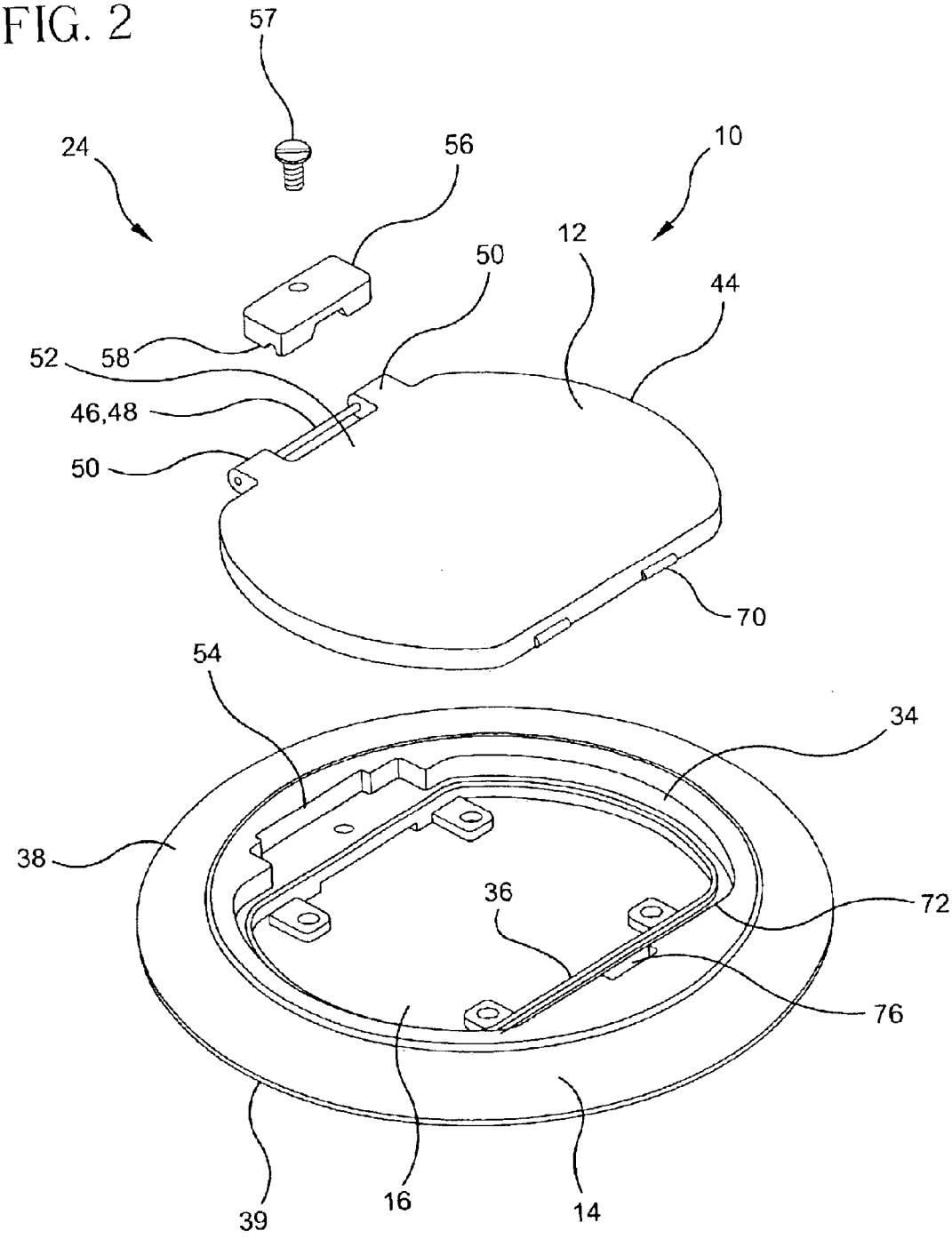
FIG. 2 is an exploded top perspective view of the electrical box cover of FIG. 1.
Figure 5:
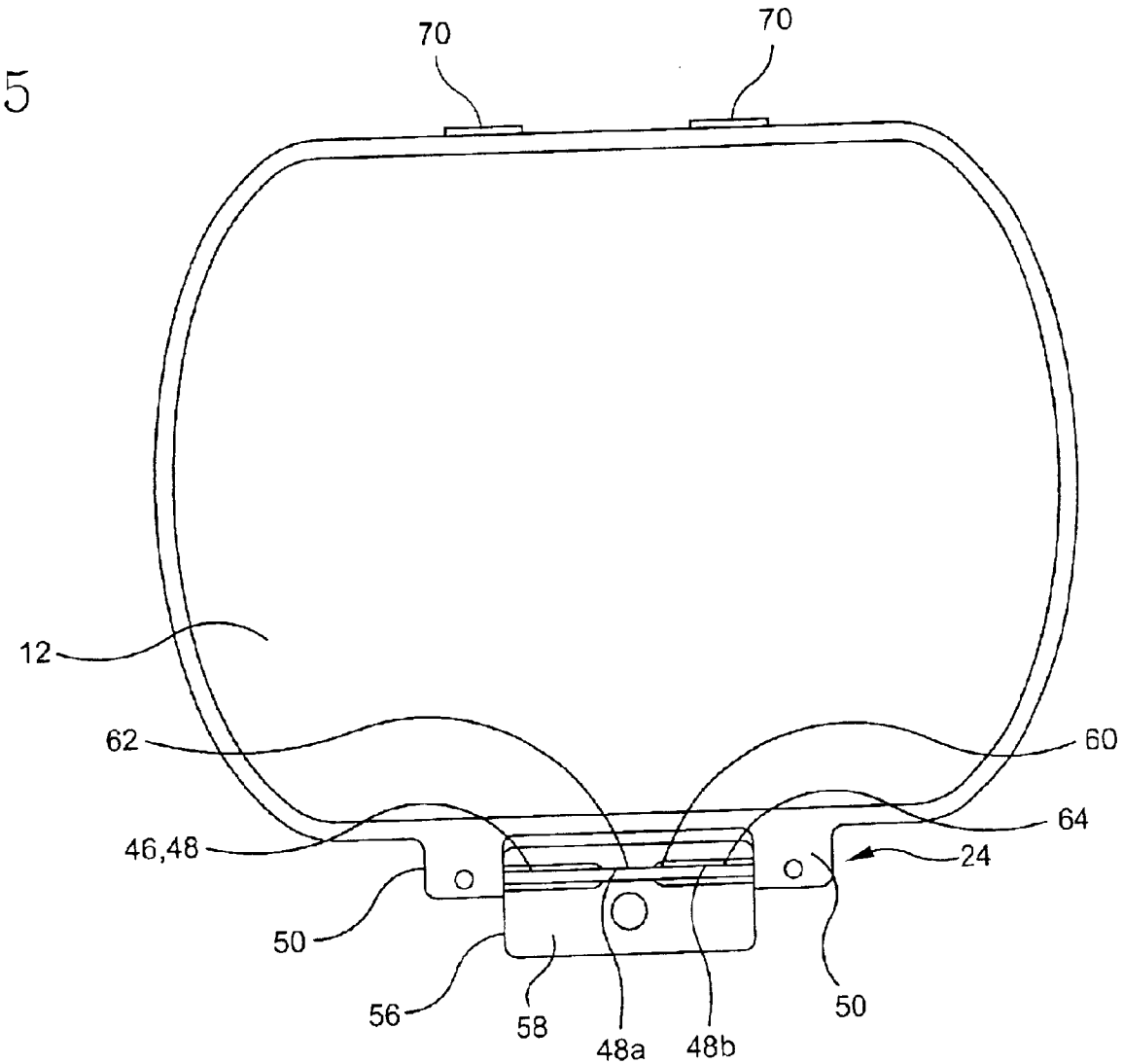
FIG. 5 is a bottom elevational view of the cover and the retainer of the present invention showing a hinge pin in a normal state.
Figure 6:
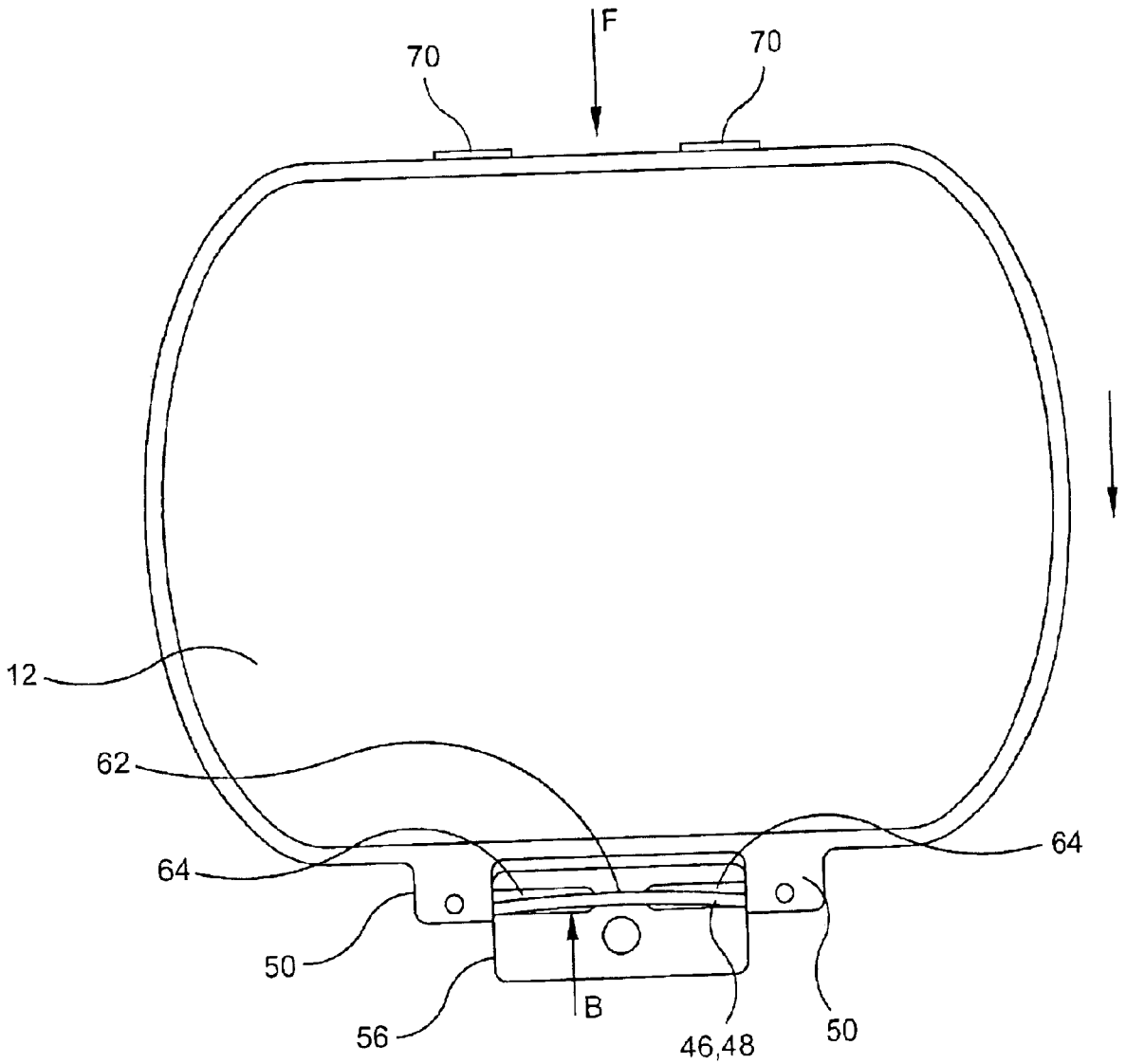
FIG. 6 is a bottom elevational view of the cover and the retainer of FIG. 5 showing the hinge pin in a deflected state.

Referring to FIGS. 2 and 5–6, in the preferred embodiment, cover 12 rotates between the open and closed position by way of hinge 24, which provides the pivotal connection between cover 12 and flange 14. Hinge 24 rotatably secures cover 12 to frame 14, and permits both rotational and translational movement of cover 12 relative to frame 14. Hinge 24 may include a biasing device 46 which permits translational movement and also urges cover 12 toward a first translational direction. The biasing force of biasing device 46 works in cooperation with latch 22 to assist in retaining cover 12 in the closed position. Cover 12 is further movable in a second translational direction opposed to the first translational direction and against the biasing device such that cover 12 is moved into an unlatched position permitting said cover to be rotated to the open position.

In the preferred embodiment, hinge 24 may include a resilient elongate member such as pin 48 that joins cover 12 to frame 14. Pin 48 may extend between and be secured at its end in a pair of spaced tabs 50 extending from the back edge 52 of cover 12. Pin 48 may be formed of a resilient material such as steel. Pin includes a central portion 48*a* and peripheral portions 48*b* (FIG. 5). Frame 14 may include a hinge seat 54 in which tabs 50 and pin 48 may be disposed. In order to pivotally secure cover to frame 14 a retainer 56 may be employed. Retainer 56 may be positioned over pin 48 and fastened to frame 14 adjacent hinge seat 54 by a fastener 57. Retainer 56 restricts a portion of pin 48 from deflection and allows another portion of pin 48 to deflect. In the preferred embodiment pin central portion 48*a* is restricted from deflection and pin peripheral portions 48*b* are permitted to deflect. The ability of pin 48 to resiliently deflect, permits pin 48 to act as a biasing member. In the preferred embodiment, retainer 56 includes an under surface 58 including a longitudinally extending groove 60 for receiving pin 48. Groove 60 may include a central portion 62 which fits in close relationship to pin 48 to hold the pin 48 against translational deflection relative to retainer groove central portion 62. Groove 60 also includes a pair of peripheral portions 64 extending outwardly from central portion 62 to the edge of retainer 56. Groove's 60 peripheral portions 64 are widened relative to central portion 62 such that a clearance is provided around pin 48 to permit translational deflection of pin 48. With the hinge 24 formed in this manner, translational movement of cover 12 by a force F in a direction toward hinge 24, causes pin 48 to flex and cover 12 to translate as shown in FIG. 6. When pin 48 is flexed, it creates a biasing force B acting against the rearward movement of cover 12 and urges cover 12 to a forward position.

Figure 4:
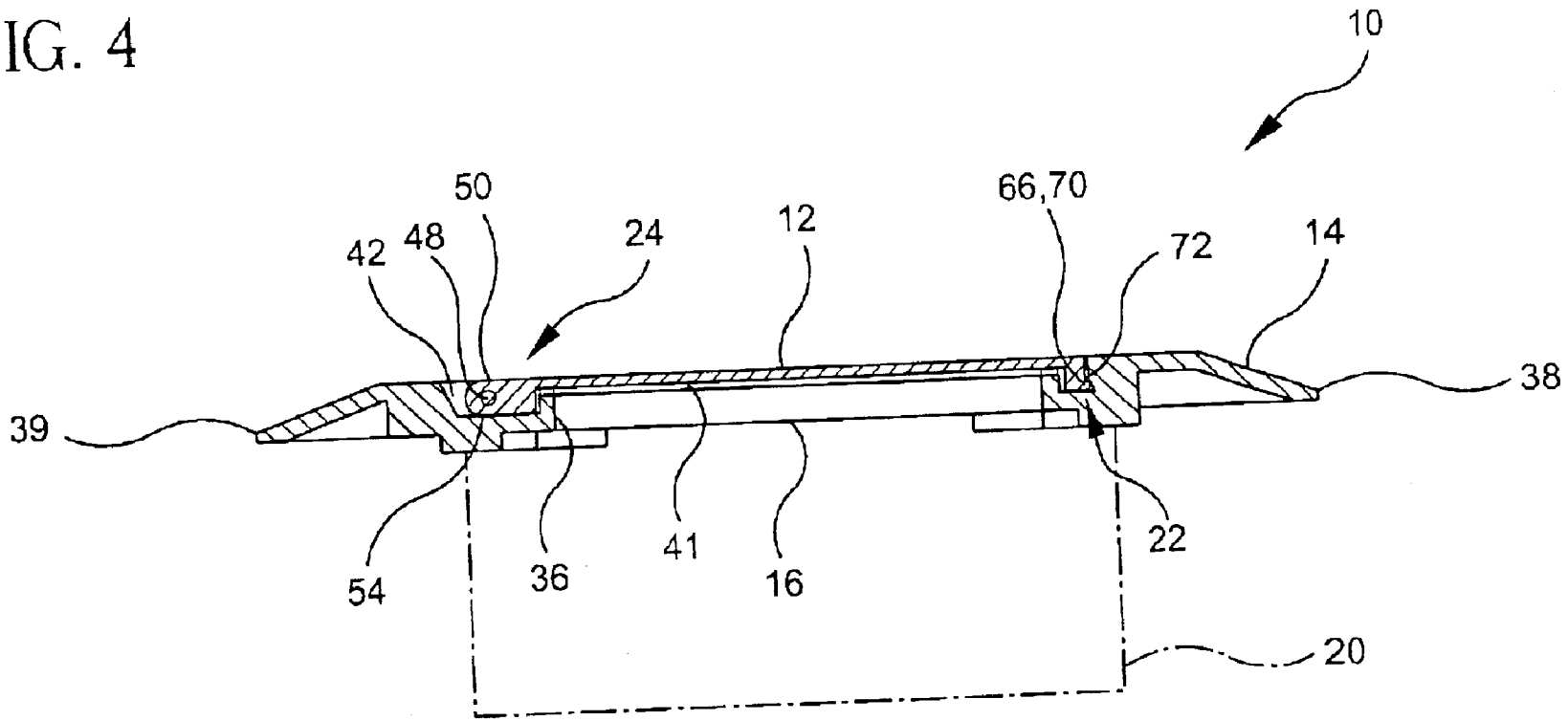
FIG. 4 is a cross-sectional view of the electrical box cover assembly taken along line IV—IV of FIG. 3.

The biasing force B permits cover to be retained in the closed position by way of a latch 22. Latch 22 may include a latching element 66 disposed between cover 12 and frame 14. Latching element 66 preferably includes a pair of projections 70 disposed on the front edge of cover 12. Projections 70 may be integrally formed with, and of the same material as, cover 12. Alternatively only one such projection may be used. Latch 22 may further include a pair of recesses 72 formed in frame 14 which is positioned and sized to receive projection 70. Recesses 72 are preferably formed in or cut into frame 14. When cover 12 is rotated into the closed position, projections 70 engage a portion of frame 14 causing cover 12 to translate in a direction against the biasing force of pin 48. Either projections 70 or recesses 72 may include a ramped or rounded portion 74 to assist in permitting projection 70 move past frame 14 and into recess 72. As shown in FIG. 4, when cover 12 is moved to the final closed position, projections 70 enters recesses 72, and cover 12 is urged to translates forward by pin 48. Projections 70 are positioned in recesses 72, thereby restricting the movement of cover 12 into the open position. It is to be understood that latch 22 could be formed with one or more projections 70 formed on frame 14 and the corresponding recesses 72 formed on cover 12. In the preferred embodiment, cover 12 and frame 14 and their corresponding projections 70 and recesses 72 may be formed of metal and be rigid, with the translational movement necessary for latching and unlatching being provided by the resiliency of pin 48.

Referring to FIGS. 3 and 4, in order to open cover 12 to obtain access to the electrical connections 18 lying below, a user would move cover 12 in a direction toward hinge 24 and against the biasing force of pin 48. Gap 42 created between cover 12 and the outer wall 34 of frame 14 permits a degree of translational movement of cover 12. Cover projection 70 moves out of recess 72 and cover 12 may be rotated toward the open position. This opening procedure may be easily done by inserting a screwdriver or similar tool (not shown) into a notch 76 formed in frame 14 and prying up cover 12.

The dual use of hinge 24 to provide both a pivotal connection between cover 12 and frame 14 and the biasing force to affect a latched condition, allows for electrical box cover assembly to be efficiently manufactured. Hinge 24 with its resilient biasing feature is advantageous where the cover and frame are formed of rigid metallic material, as in the preferred embodiment, by creating a snap shut capability without the need for additional clasps, springs or locking fasteners. In addition, cover 12 may be easily retained in the closed position by simply rotating cover 12 to the closed position and pressing cover 12 until projections 70 snap into recesses 72.

Figure 7:
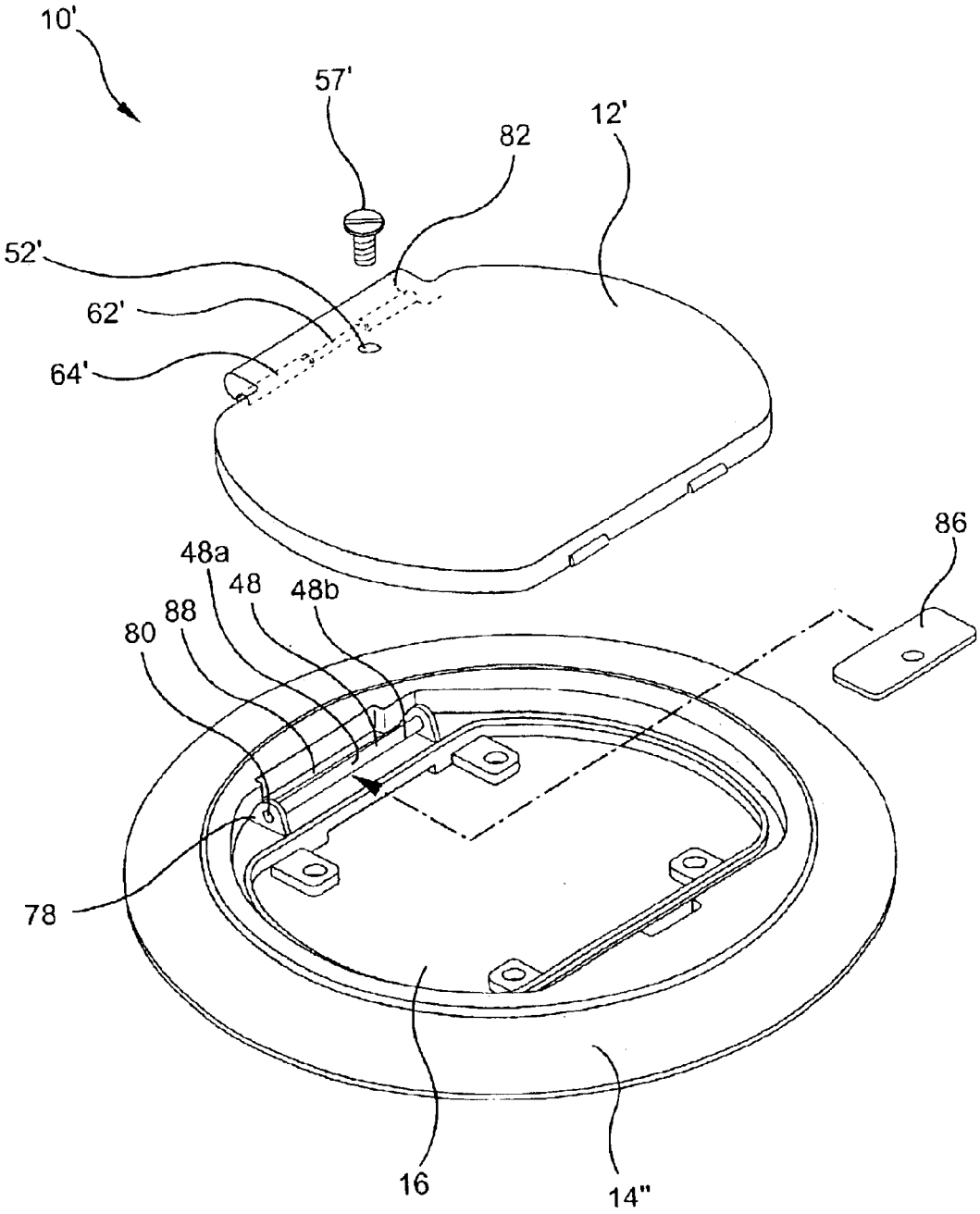
FIG. 7 is an exploded top perspective view of an alternative embodiment of floor box cover assembly of the present invention.
Figure 8:
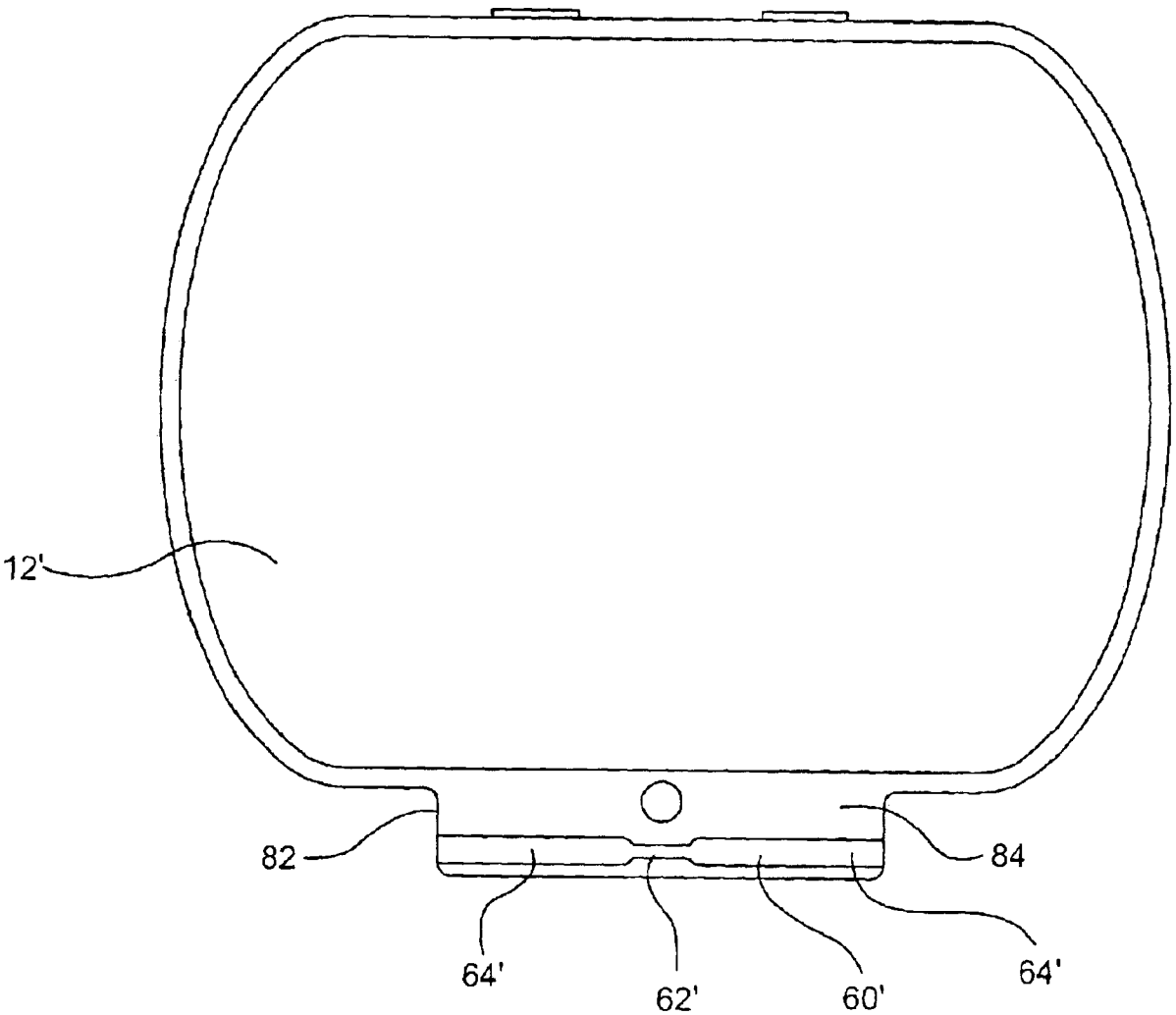
FIG. 8 is a bottom elevational view of the cover of FIG. 7.

A further alternative embodiment of cover assembly 10' is shown in FIGS. 7 and 8. This embodiment differs from the previously described embodiments in that pin 48 may be secured at its ends to frame 14". Frame 14" may include a pair of spaced pin posts 78 thereon having openings 80 to hold the ends of pin 48. Cover 12' may include an extension 82 having a bottom surface 84 including a groove 60'. Groove 60' is similarly formed to groove 60 formed on retainer 56 described above and includes a narrow central portion 62' and a pair of peripheral laterally extending wider portions 64'. Groove 60' is configured to receive pin 48 such that a pin central portion 48*a* is closely held by groove central portion 62' and pin peripheral portions 48*b* located in groove peripheral portions 64' are permitted to deflect. Accordingly, rotational and translation movement is permitted as in the embodiment shown in FIGS. 1–6. A plate 86 may be disposed over pin 48 and secured to extension bottom surface 84 in order to retain pin in groove 60' and retain cover 12' to frame 14". Additionally, frame 14" may include a depression 88 beneath pin 48 in order to permit clearance for extension 82 when cover 12' is moved to the open position. In a further alternative embodiment (not shown), extension could have a flat surface and plate 86 could be formed as retainer 56 including a groove having a varying width.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A cover assembly for an electrical box comprising:

a frame having an opening positionable over the box;

a cover selectively positionable over said opening and rotatable between a closed position and an open position;

a hinge rotatably securing said cover to said frame, said hinge permitting rotational and translational movement of said cover relative to said frame, said hinge including a biasing device for urging said cover toward a first translational direction;

a latch including a locking element disposed between said cover and said frame for retaining said cover in said closed position, said biasing device deflecting upon movement of said cover into said closed position and urging said locking element into a retaining position such that said locking element restricts movement of said cover to said open position.

2. The cover assembly as defined in claim 1, wherein said cover is movable in a second translational direction opposed to said first translational direction and against said biasing device such that said locking element is moved into an unretained position permitting said cover to be rotated to said open position.

3. The cover assembly as defined in claim 1, wherein cover includes a pair of spaced projections and said biasing device is secured to and extends between said pair of projections.

4. The cover assembly as defined in claim 1, wherein said locking element includes a protrusion extending from said cover selectively engagable with said frame.

5. The cover assembly as defined in claim 1, wherein said hinge includes an elongate member joining said cover and said frame.

6. The cover assembly as defined in claim 5, wherein said elongate member is supported on said cover.

7. The cover assembly as defined in claim 5, wherein said elongate member is supported on said frame.

8. The cover assembly as defined in claim 5, wherein said elongate member is a resilient pin and forms said biasing device.

9. The cover assembly as defined in claim 8, wherein said pin includes a pair of opposed ends and a portion of said pin located between pair of ends is restricted from deflecting upon translational movement of said cover.

10. The cover assembly as defined in claim 9, wherein said pin includes a central portion and a pair of peripheral portions extending form said central portion, and said peripheral portions of said pin are permitted to deflect thereby permitting translational movement of said cover.

11. The cover assembly as defined in claim 10, wherein said hinge further includes a retainer disposable adjacent said pin, said retainer including a first section for restricting deflection of said pin central portion and a second section permitting deflection of said peripherals portions of said pin.

12. The cover assembly as defined in claim 11, wherein said retainer includes a groove forming said first and second sections for receiving said pin, said first section being narrower than said second section.

13. The cover assembly as defined in claim 11, wherein said retainer is secured to said frame.

14. The cover assembly as defined in claim 1, wherein said frame includes a an outer periphery having a tapered surface.

15. The cover assembly as defined in claim 14, wherein said frame includes an inner and outer wall, said inner wall defining said opening, said inner and outer walls defining a channel therebetween.

16. The cover assembly as defined in claim 15, wherein said outer wall includes a slot therein to permit a path for fluid entering said channel to exit away from said frame.

17. A cover assembly for an electrical box comprising:

a frame having an opening positionable over the box;

a cover selectively positionable over said opening and rotatable between a closed position and an open position;

a hinge rotatably securing said cover to said frame, said hinge permitting rotational and translational movement of said cover relative to said frame, said hinge having a member including a first portion secured to said frame and a second portion secured to said cover, one of said first and second portions of said member being translatable relative to said other of said first and second portions said hinge including a biasing device for urging said cover toward a first translational direction;

a locking element disposed between said cover and said frame for retaining said cover in said closed position.

18. The cover assembly as defined in claim 17, wherein said cover is movable in a second translational direction opposed to said first translational direction and against said biasing device such that said locking element is moved into an unretained position permitting said cover to be rotated to said open position.

19. The cover assembly as defined in claim 18, wherein said biasing device includes a pin joining said cover and said frame.

20. The cover assembly as defined in claim 19, wherein said pin includes a central section and peripheral sections extending outwardly from said central section, and wherein said central section is held against deflection and said peripheral sections are permitted to deflect upon translational movement of said cover.

21. The cover assembly as defined in claim 19, wherein said hinge includes a retainer disposed over said pin for retaining said cover to said frame.

22. The cover assembly as defined in claim 19, wherein said pin is retained at its ends to said frame and said cover includes a portion including a groove adapted to receive said pin, said groove having a first portion for restricting deflection of said pin and a second portion for permitting deflection of said pin upon translational movement of said cover.

23. The cover assembly as defined in claim 22, wherein said hinge further includes a plate disposed over said pin and secured to said cover for retaining said cover to said frame.

24. The cover assembly as defined in claim 18, wherein said frame includes an inner and outer wall, said inner wall defining said opening, said inner and outer walls defining a channel therebetween.

25. The cover assembly as defined in claim 24, wherein said outer wall includes a slot therein to permit a path for fluid entering said channel to exit away from said frame.

26. A hinge for an electrical box cover including a cover and frame comprising:

a resilient elongate member supported at each end thereof on either the cover or the frame;

a retainer, positionable over said elongate member, said retainer being attachable to either the cover or the frame, said retainer including a first section for preventing deflection of said elongate member and a second section configured to permit deflection of said elongated member said hinge permitting rotation and translation of the cover relative to the frame and a biasing device for urging said cover toward a translational direction.

27. The hinge as set forth in claim 26, wherein said retainer includes a groove extending along a surface thereof, and said groove having a narrow portion forming said retainer first section and a wider portion forming said retainer second section.

28. The hinge as set forth in claim 27, wherein said elongate member is supported on said cover and said retainer is fastenable to said frame.

29. A cover assembly for an electrical box comprising:

a frame having an opening positionable over the box;

a cover selectively positionable over said opening and rotatable between a closed position and an open position;

a hinge rotatably securing said cover to said frame, said hinge permitting rotational and translational movement of said cover relative to said frame, said hinge having a resilient elongate member secured at its ends to said cover, said elongate member forming a biasing device for urging with a biasing force said cover toward a first translational direction;

a latch including a locking element disposed between said cover and said frame for retaining said cover in said closed position, said biasing device deflecting upon movement of said cover into said closed position and urging said locking element into a retaining position such that said locking element restricts movement of said cover to said open position; and said cover being movable in a second translational direction opposed to said first translational direction and against said biasing force, whereby said locking element is moved into an unretained position permitting said cover to be rotated to said open position.

30. The cover assembly as defined in claim 29, wherein said hinge further includes a retainer disposable adjacent said elongate member, said retainer including a first section for restricting deflection of said elongate member central portion and a second section permitting deflection of said peripherals portions of said elongate member.

31. A cover assembly for an electrical box comprising:

a frame having an opening positionable over the box;

a cover selectively positionable over said opening and rotatable between a closed position and an open position;

a hinge rotatably securing said cover to said frame, said hinge permitting rotational and translational movement of said cover relative to said frame, said hinge including a biasing device for urging said cover toward a first translational direction, wherein said biasing device includes a pin joining said cover and said frame, said pin includes a central section and peripheral sections extending outwardly from said central section, and wherein said central section is held against deflection and said peripheral sections are permitted to deflect upon translational movement of said cover; and a locking element disposed between said cover and said frame for retaining said cover in said closed position.

32. A cover assembly for an electrical box comprising:

a frame having an opening positionable over the box;

a cover selectively positionable over said opening and rotatable between a closed position and an open position;

a hinge rotatably securing said cover to said frame, said hinge permitting rotational and translational movement of said cover relative to said frame, said hinge including a biasing device for urging said cover toward a first translational direction, said biasing device including a pin joining said cover and said frame, wherein said pin is retained at its ends to said frame and said cover includes a portion including a groove adapted to receive said pin, said groove having a first portion for restricting deflection of said pin and a second portion for permitting deflection of said pin upon translational movement of said cover; and a locking element disposed between said cover and said frame for retaining said cover in said closed position.

33. A cover assembly for an electrical box comprising:

a frame having an opening positionable over the box, said frame including an inner and outer wall, said inner wall defining said opening, and said inner and outer walls defining a channel therebetween, said outer wall including a slot therein extending to an outer perimeter of said frame to form a path for fluid entering said channel to exit away from said opening and said frame;

a cover selectively positionable over said opening and rotatable between a closed position and an open position;

a hinge rotatably securing said cover to said frame, said hinge permitting rotational and translational movement of said cover relative to said frame, said hinge including a biasing device for urging said cover toward a first translational direction;

a locking element disposed between said cover and said frame for retaining said cover in said closed position.

* * * * *